US007954345B2

(12) United States Patent
Park

(10) Patent No.: US 7,954,345 B2
(45) Date of Patent: Jun. 7, 2011

(54) WASHING MACHINE WITH ORNAMENTAL PANEL

(75) Inventor: Jong Won Park, Gwangmyeong-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 370 days.

(21) Appl. No.: 12/073,461

(22) Filed: Mar. 5, 2008

(65) Prior Publication Data

US 2008/0223085 A1 Sep. 18, 2008

(30) Foreign Application Priority Data

Mar. 8, 2007 (KR) ..... 10-2007-0023080

(51) Int. Cl.
*D06F 21/00* (2006.01)

(52) U.S. Cl. ..... 68/139

(58) Field of Classification Search ..... 68/139
See application file for complete search history.

(56) References Cited

U.S. PATENT DOCUMENTS

| | | | | |
|---|---|---|---|---|
| 3,802,391 | A * | 4/1974 | Peeler | 119/479 |
| 4,229,921 | A | 10/1980 | Schell | |
| 4,732,431 | A * | 3/1988 | Mason | 312/109 |
| 5,520,453 | A * | 5/1996 | Aoki et al. | 312/406 |
| 5,908,227 | A * | 6/1999 | Wilhelmstatter et al. | 312/204 |

FOREIGN PATENT DOCUMENTS

| | | | |
|---|---|---|---|
| DE | 23 65 027 | | 7/1975 |
| DE | 4031900 | * | 4/1992 |
| DE | 10 2006 030 024 | | 2/2007 |
| EP | 1389643 | * | 2/2004 |
| GB | 2 115 473 | | 9/1983 |
| JP | 11-62410 | * | 3/1999 |
| JP | 2001-269498 | | 10/2001 |
| JP | 2004-89325 | * | 3/2004 |

OTHER PUBLICATIONS

Machine translation of JP11-62410 (Mar. 1999).*
Machine translation of DE 4031900 (Apr. 1999).*
Machine translation of JP2004-89325 (Mar. 2004).*
European Communication and Search Report for corresponding European Application 0815936.5 Mailed Jul. 10, 2008.

* cited by examiner

*Primary Examiner* — Michael Barr
*Assistant Examiner* — Samuel A Waldbaum
(74) *Attorney, Agent, or Firm* — Staas & Halsey LLP

(57) ABSTRACT

A washing machine to guarantee easy mounting or separation of an ornamental panel and prevent the coming off or distortion of door trims. The washing machine includes a body having a laundry opening, a door mounted to the body to open or close the laundry opening and having a rim, an ornamental panel mounted to an outer surface of the door, a plurality of door trims coupled to the rim of the door supporting the ornamental panel, and a coupling device coupling of the door trims. The coupling device includes a plurality of holding recesses formed in the rim of the door and spaced apart from one another, and a plurality of holding hooks protruding from an inner surface of the respective door trims to be introduced into and caught by the holding recesses.

9 Claims, 7 Drawing Sheets

WASHING MACHINE WITH ORNAMENTAL PANEL

CROSS-REFERENCE TO RELATED APPLICATIONS

This application claims the benefit of Korean Patent Application No. 2007-0023080, filed on Mar. 8, 2007 in the Korean Intellectual Property Office, the disclosure of which is incorporated herein by reference.

BACKGROUND

1. Field

The present invention relates to a washing machine, and, more particularly, to a washing machine having an ornamental panel to be mounted to a front surface of a door and door trims for the mounting of the ornamental panel.

2. Description of the Related Art

A washing machine, disclosed in Japanese Patent Laid-open Publication No. 2001-0269498, includes a body having a laundry opening formed in a front surface thereof, and a door installed to the front surface of the body to open or close the laundry opening. To provide the washing machine with an aesthetic outer appearance, the door is configured to cover the laundry opening and the front surface of the body around the laundry opening.

In the case of the washing machine, since a color of the door is determined during manufacturing, it is difficult to change the outer appearance of the front surface, especially the color of the door for a customer's tastes. To solve this problem, recently some washing machines have been configured such that a replaceable ornamental panel is installed to a front surface of a door to allow a customer to change the outer appearance of the front surface into a desired color or design. The ornamental panel used is made of a variety of colors of resin, reinforced glass, etc. In this case, a plurality of door trims is provided at a coupling rim region of the ornamental panel and the door.

Specifically, the conventional washing machines are configured such that, after arranging the plurality of door trims at the coupling rim region of the ornamental panel and the door, a plurality of fixing screws are fastened to mount the ornamental panel at a fixed position. This mounting structure, however, has a difficulty in the mounting and separation of the ornamental panel when a customer later tries to replace the ornamental panel with a new panel. Furthermore, when the door trims are deformed after a long period of use thereof, joint portions of the respective door trims (for example, corners of the door trims) may come off, resulting in a deterioration of the outer appearance.

SUMMARY

The present embodiment has been made in order to solve the above problems. It is an aspect of the embodiment to provide a washing machine to guarantee easy mounting or separation of an ornamental panel.

It is a further aspect of the invention to provide a washing machine capable of preventing the coming off or distortion of door trims.

Additional aspects and/or advantages will be set forth in part in the description which follows and, in part, will be obvious from the description, or may be learned by practice of the invention.

In accordance with the invention, the above and/or other aspects can be achieved by the provision of a washing machine including a body having a laundry opening, a door mounted to the body opening and closing the laundry opening and having a rim, an ornamental panel mounted to an outer surface of the door, a plurality of door trims coupled to the rim of the door supporting the ornamental panel, and a coupling device coupling the door trims to the door, the coupling device including a plurality of holding recesses formed in the rim of the door and spaced apart from one another, and a plurality of holding hooks protruding from an inner surface of the respective door trims to be introduced into and caught by the holding recesses.

The coupling device may further include: a plurality of coupling guide protrusions extending from an inner surface of the respective door trims in a coupling direction of the respective door trims at positions between the neighboring holding hooks; and elongated coupling guide bores formed in the door and extending in the coupling direction of the respective door trims, to guide a coupling of the coupling guide protrusions.

Ends of the holding hooks may be exposed to an inner surface of the door in a completely coupled state of the holding hooks, to allow the holding hooks to be easily separated from the holding recesses.

Each of the plurality of door trims may include a bent portion to cover a rim of the ornamental panel.

Each of the holding hooks may include a first supporting rib to support the ornamental panel to press the ornamental panel toward the associated bent portion, to prevent movement of the ornamental panel, and a second supporting rib extending from the first supporting rib to support the rim of the ornamental panel to space the rim of the ornamental panel apart from an inner surface of the associated door trim.

The door and the ornamental panel may have a rectangular panel shape to cover a front surface of the body, the door having upper and lower ends, the plurality of door trims may include upper and lower door trims mounted, respectively, to the upper and the lower ends of the door, and two lateral door trims coupled to both lateral ends of the door, and each of the upper and lower door trims may have cover portions provided at both ends thereof to cover ends of the two lateral door trims, and each of the two lateral door trims has stepped coupling portions provided at both ends thereof to be covered by the cover portions.

The coupling device may further include a plurality of coupling guide protrusions extending from an inner surface of the respective door trims in a coupling direction of the respective door trims at positions between the neighboring holding hooks, and elongated coupling guide bores formed in the door and extending in the coupling direction of the respective door trims, to guide a coupling of the coupling guide protrusions.

The foregoing and/or other aspects are achieved by providing a washing machine, including: a body receiving laundry to be washed and including an opening; a door mounted to the body and covering the opening, the door having a plurality of holding recesses; a plurality of door trims coupled to the door, each of the door trims having a plurality of holding hooks receivable into and latched onto the holding recesses; and an ornamental panel mounted to the door and held between the door trims and the door.

The holding hooks may include a first supporting rib supporting the ornamental panel against the associated door trim and a second supporting rib extending from the first supporting rib spacing a rim of the ornamental panel apart from an inner surface of the associated door trim.

The door may include a plurality of guide bores and each of the door trims may include a plurality of coupling guide protrusions receivable into the guide bores.

The holding recesses may each include a holding portion and the holding hooks may each include a crooked end portion, the crooked end portion of the holding hook latching onto the holding portion of the holding recess to hold the holding hook into the holding recess.

The foregoing and/or other aspects are achieved by providing a door of a washing machine, including: a door part having a plurality of holding recesses; a plurality of door trims coupled to the door part, each of the door trims having a plurality of holding hooks receivable into and latched onto the holding recesses; and an ornamental panel mounted to the door part and held between the door trims and the door part.

BRIEF DESCRIPTION OF THE DRAWINGS

These and/or other aspects and advantages of the embodiment will become apparent and more readily appreciated from the following description of the embodiments, taken in conjunction with the accompanying drawings, of which.

DETAILED DESCRIPTION OF THE EMBODIMENT

Figure 1:
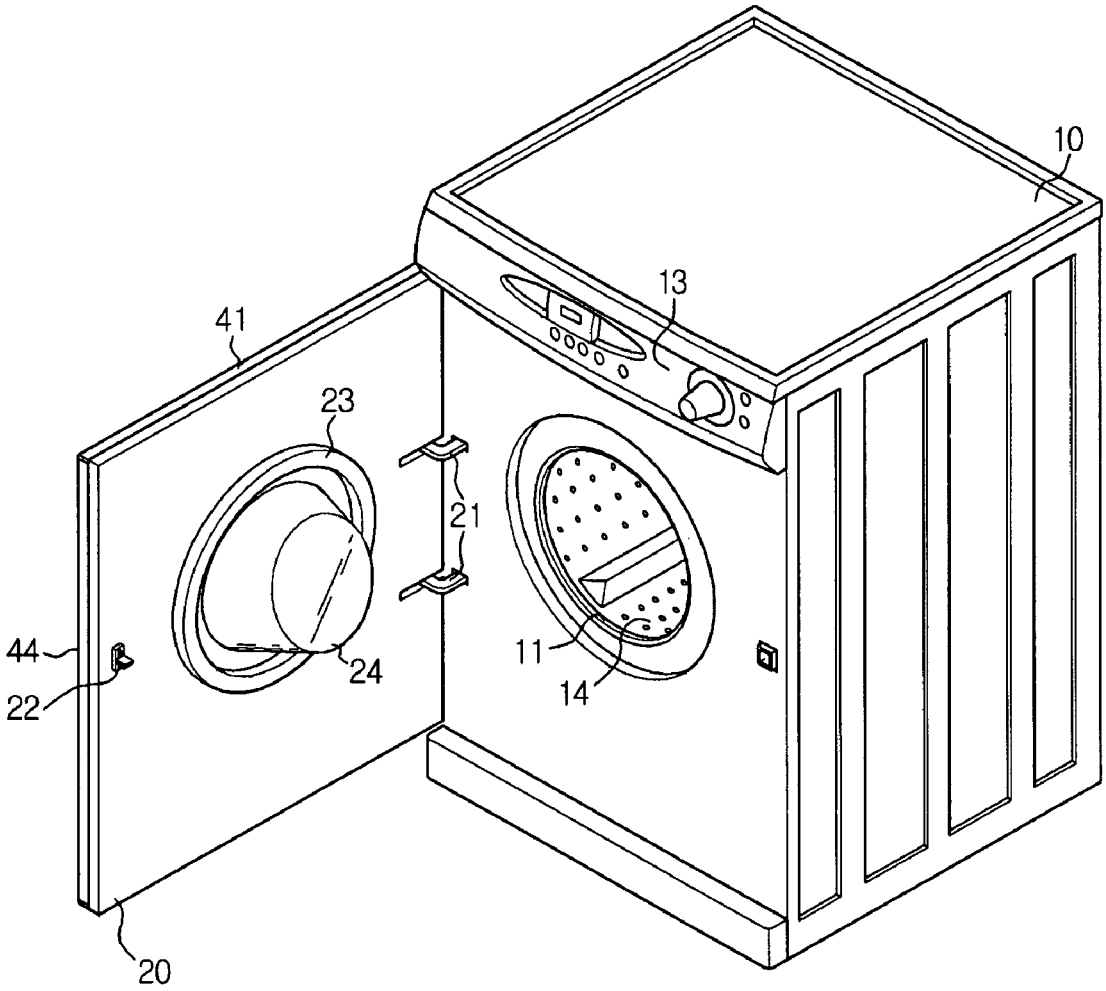
FIG. 1 is a perspective view of a washing machine in accordance with the present embodiment.

Reference will now be made in detail to embodiment, an example of which are illustrated in the accompanying drawings, wherein like reference numerals refer to like elements throughout. The embodiment is described below to explain the present invention by referring to the figures.

FIG. 1 illustrates a drum type washing machine in accordance with the present embodiment. The washing machine includes a body 10 having a laundry opening 11 formed in a front surface thereof to put or take laundry into or out of the body 10, and a door 20 installed to the front surface of the body 10 to open or close the laundry opening 11. A control panel 13 is provided at an upper portion of the front surface of the body 10 and is used to control the operation mode of the washing machine and to display the operation state of the washing machine.

Although not shown in the drawing, the body 10 is internally provided with a water tub to be filled with wash water, a rotating drum 14 rotatably installed in the water tub, a drive motor to rotate the rotating drum 14, a water supply device to supply wash water, a water drainage device, etc.

The door 20 has a rectangular panel form capable of covering a wide area of the front surface of the body 10 including the laundry opening 11. The door 20 is rotatably coupled at one side thereof to the body 10 by use of hinges 21, for example, and provided at an opposite side of the hinges 21 with a locker 22. The door 20 further has a center sealing portion 23 to hermetically close the laundry opening 11 and a circular truncated portion 24 to be inserted into the laundry opening 11. The circular truncated portion 24 may be made of a transparent material to show an interior of the rotating drum 14. In addition, a viewing window 25 is provided at a center of the door 20 as shown in FIG. 2.

Figure 2:
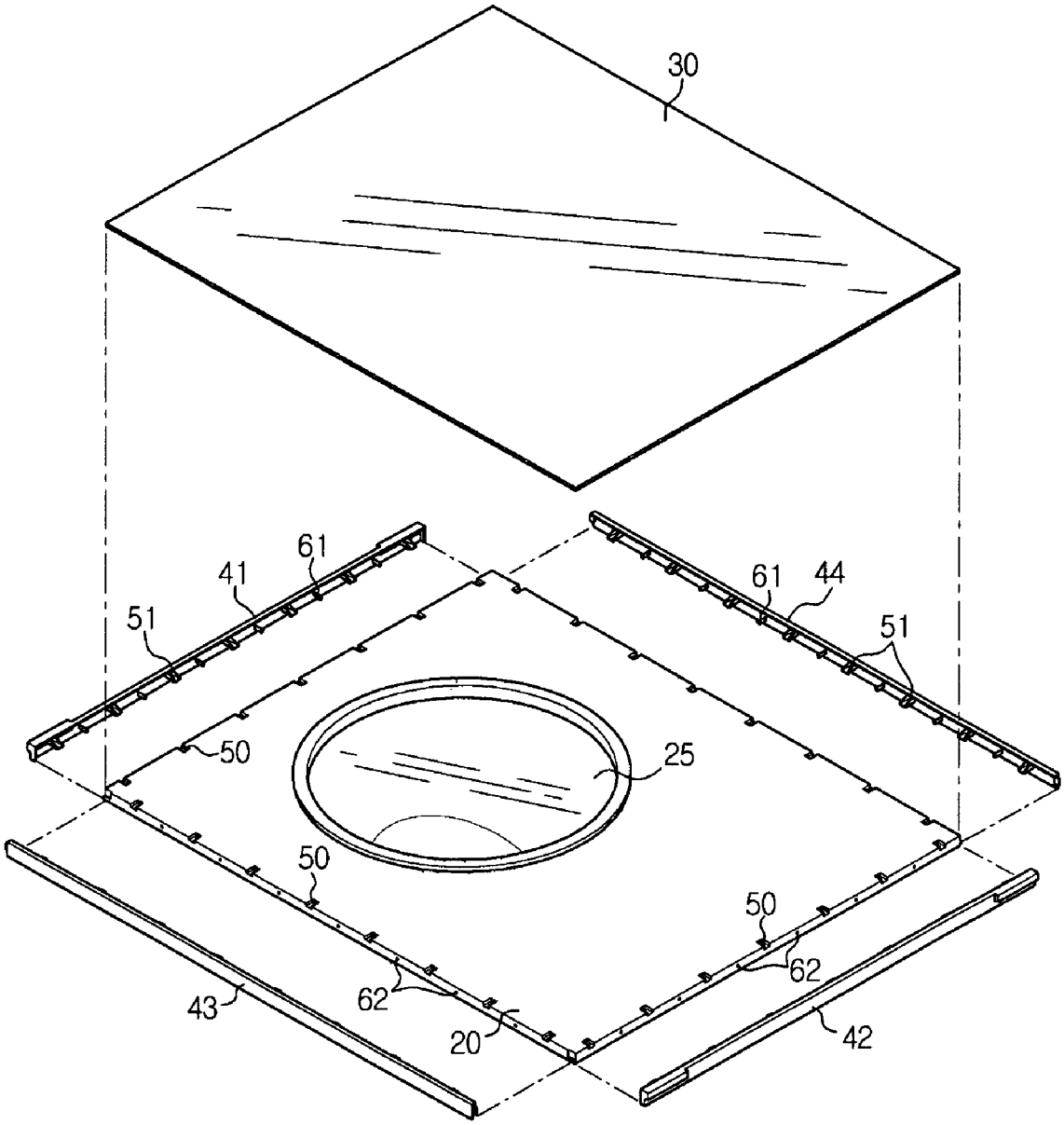
FIG. 2 is an exploded perspective view illustrating an ornamental panel to be mounted to a door of the washing machine and door trims to mount the ornamental panel in accordance with the present embodiment.

As shown in FIG. 2, a detachable ornamental panel 30 is installed to an outer surface of the door 20, and in turn, a plurality of door trims 41, 42, 43 and 44 is installed along a rim of the door 20, to mount the ornamental panel 30. The ornamental panel 30 has a size corresponding to that of the door 20, to completely cover a front surface of the door 20. The ornamental panel 30 may be made of a variety of colors of glass or resin, for example, to provide the front surface of the body 10 with an aesthetic outer appearance.

The ornamental panel 30 may be a transparent panel to show the interior of the body 10 through the viewing window 25, or may be an opaque panel printed at a front surface thereof with a variety or patterns or pictures. Therefore, a desired color or shape of the ornamental panel 30 is selected from among a variety of ornamental panels for a customer's tastes.

Figure 4:
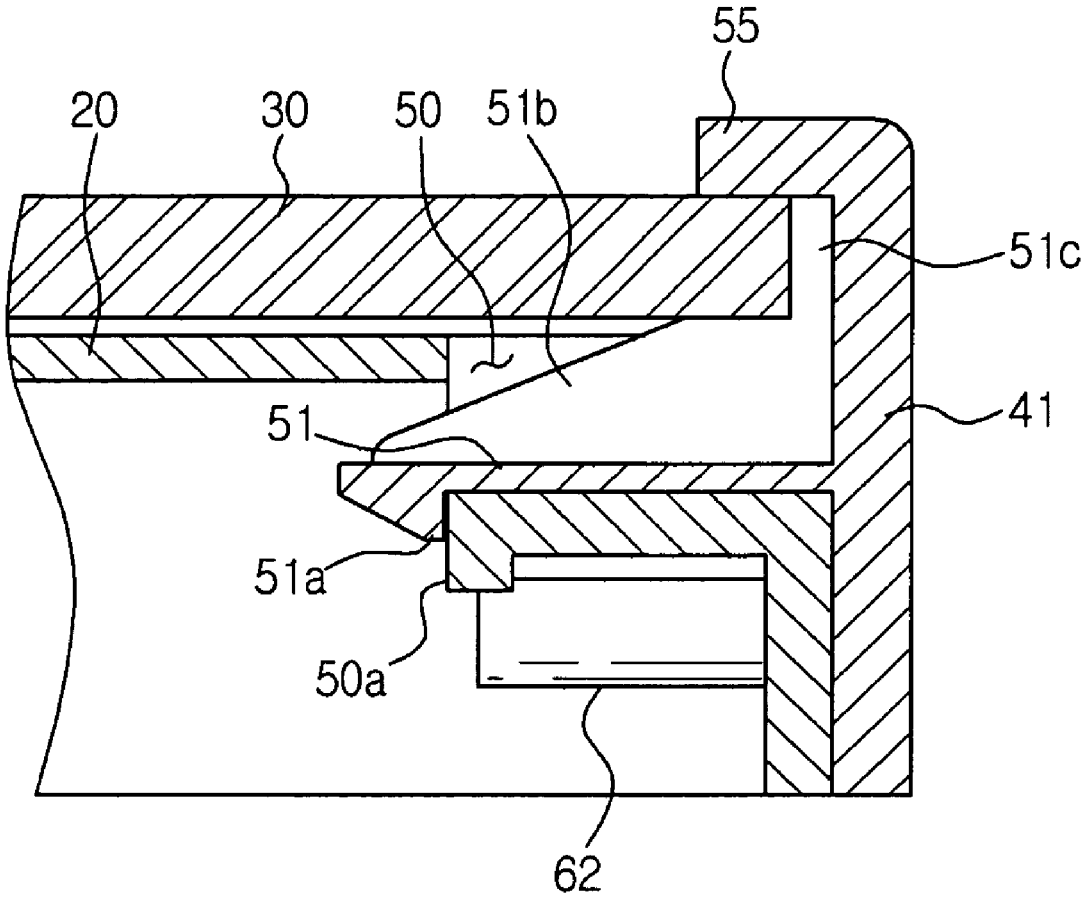
FIG. 4 is a sectional view of the mounting structure of the door trim, which is mounted to the door of the washing machine in accordance with the present embodiment.

The plurality of door trims 41, 42, 43 and 44 include an upper door trim 41 to be mounted to an upper end of the door 20, a lower door trim 42 to be mounted to a lower end of the door 20, and two lateral door trims 43 and 44 to be mounted, respectively, to both lateral ends of the door 20. The door trims 41-44, as shown in FIG. 4, are coupled to the rim of the door 20 and used to cover the rim region of the ornamental panel 30 and the door 20 while supporting the ornamental panel 30. Accordingly, the door trims 41-44 have the effect of providing the door 20 with an aesthetic outer appearance.

To couple the door trims to the door 20, the rim of the door 20 may be formed with a plurality of holding recesses 50 at predetermined intervals thereof. Each of the door trims 41, 42, 43 and 44 is formed, at an inner surface thereof, with a plurality of holding hooks 51. The holding hooks 51 are formed at positions corresponding to the respective holding recesses 50, so as to be introduced into and caught by the holding recesses 50, respectively.

Figure 3:
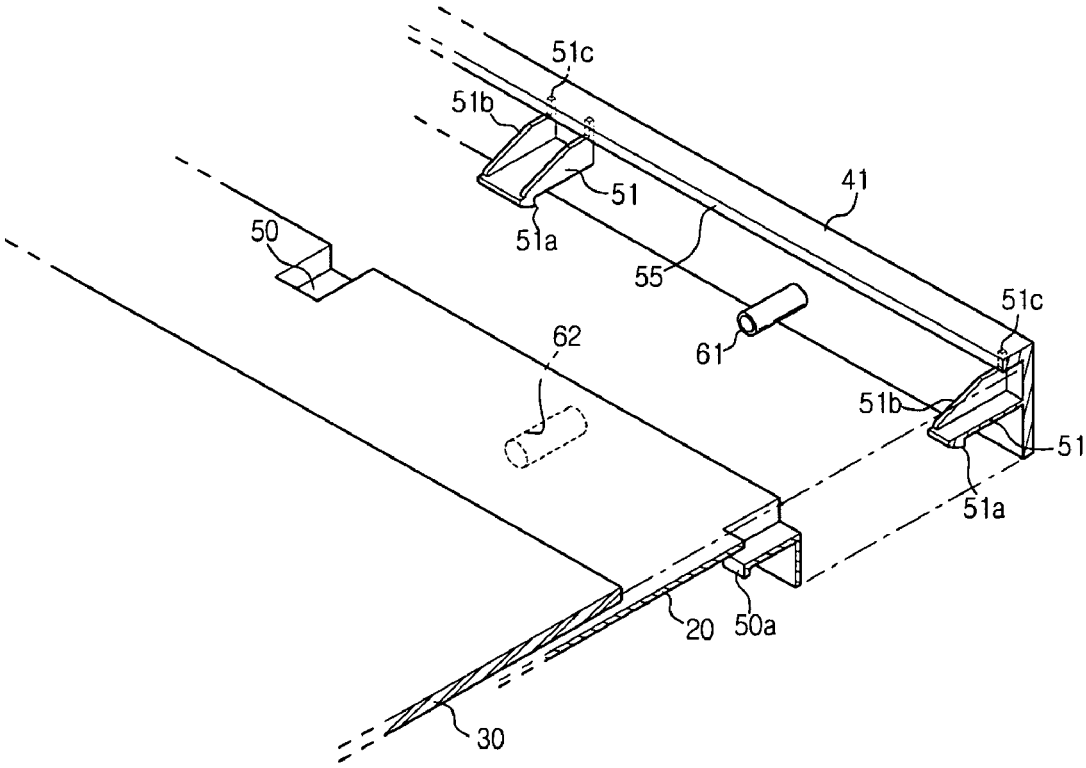
FIG. 3 is an exploded perspective view illustrating the mounting structure of the door trim included in the washing machine in accordance with the present embodiment.

Each holding hook 51, as shown in FIG. 3, protrudes from an inner surface of the door trim 41 in a coupling direction of the door trim 41, and has a crooked end portion 51*a*. The holding recess 50 has an aperture at a position close to the front surface of the door 20 and a holding portion 50*a* formed at an inner surface of the door 20. The crooked end portion 51*a* of the holding hook 51 is configured to be caught by the holding portion 50*a* of the holding recess 50.

Figure 5:
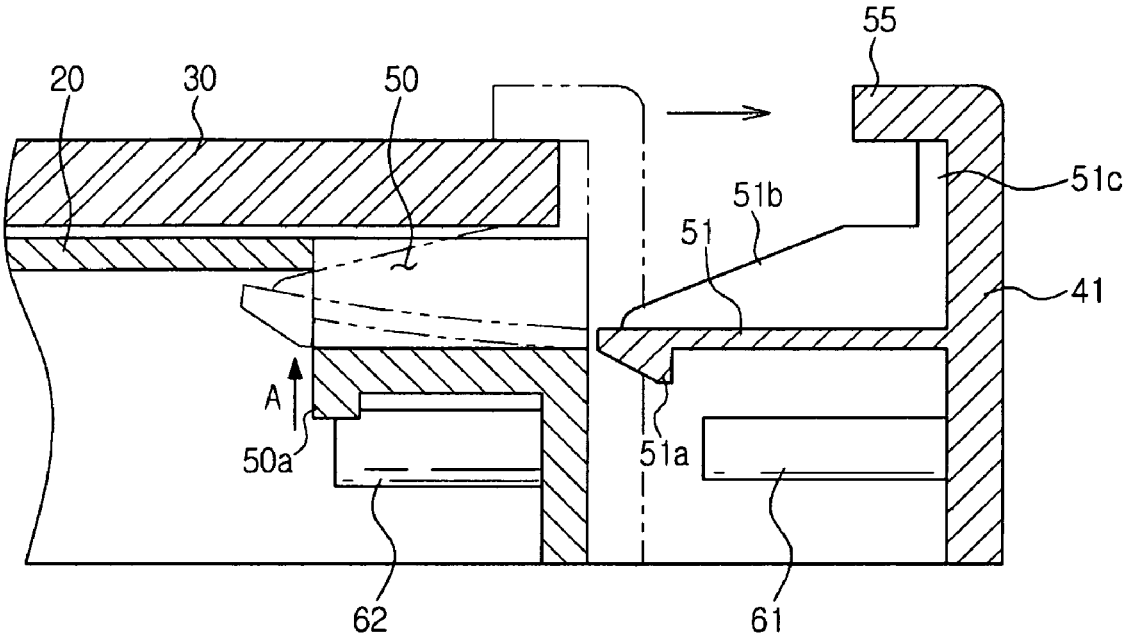
FIG. 5 is a sectional view of the mounting structure of the door trim, which is separated from the door of the washing machine in accordance with the present embodiment.

As shown in FIGS. 4 and 5, in a completely mounted state of the door trim 41, the crooked end portion 51*a* of the holding hook 51 is exposed to an inner surface of the door 20, to be easily separated from the holding recess 50. Accordingly, when it is desired, for example, to separate the holding hook 51 from the holding recess 50 for the replacement of the ornamental panel 30, as shown in FIG. 5, the holding hook 51 can be easily separated by pushing the crooked end portion 51*a* in a direction as designated by arrow A in FIG. 5. Although not shown in the drawings in detail, the inner surface of the door 20 may be provided with a cover to shield the exposed crooked end portion 51*a*. Alternatively, the crooked end portion 51*a* may be kept in an exposed state without using the cover.

The inner surface of each door trim 41, 42, 43 or 44 is provided with a plurality of coupling guide protrusions 61 between the respective neighboring holding hooks 51. The coupling guide protrusions 61 protrude in a coupling direction of the door trim by a predetermined length. The rim of the door 20, as shown in FIG. 3, is formed with elongated coupling guide bores 62 extending in the coupling direction of the door trim at positions corresponding to the respective coupling guide protrusions 61. By using the coupling guide bores 62 to guide the introduction of the coupling guide protrusions 61, accurate mounting of the door trim 41 can be accomplished, and it is possible to prevent the mounted door trim 41 from being distorted. Preventing the distortion of the door trim 41 has an effect of preventing the holding hooks 51 from being separated from the holding recesses 50, therefore there is no risk of unintentional separation of the mounted door trim 41 from the door 20.

Each of the door trims 41, 42, 43 and 44, as shown in FIGS. 3 and 4, has a bent portion 55, which is bent toward a front surface of the ornamental panel 30 to cover a part of the rim of the ornamental panel 30. The bent portion 55, as shown in FIG. 4, supports the front surface of the rim of the ornamental panel 30, thereby preventing separation of the ornamental panel 30 and covering the rim of the ornamental panel 30, to provide an aesthetic outer appearance.

Each holding hook 51 further has a first supporting rib 51*b* to press an inner surface of the rim of the ornamental panel 30 toward the bent portion 55, and a second supporting rib 51*c* to space the rim of the ornamental panel 30 apart from an inner surface of the door trim 41 by a predetermined distance. The first supporting rib 51*b* forces the ornamental panel 30 to come into close contact with an inner surface of the bent portion 55, thereby preventing the movement of the ornamental panel 30. The second supporting rib 51*c* spaces the rim of the ornamental panel 30 from the inner surface of the door trim 41, thereby protecting the ornamental panel 30 from an external shock applied to the door trim 41.

Figure 6:
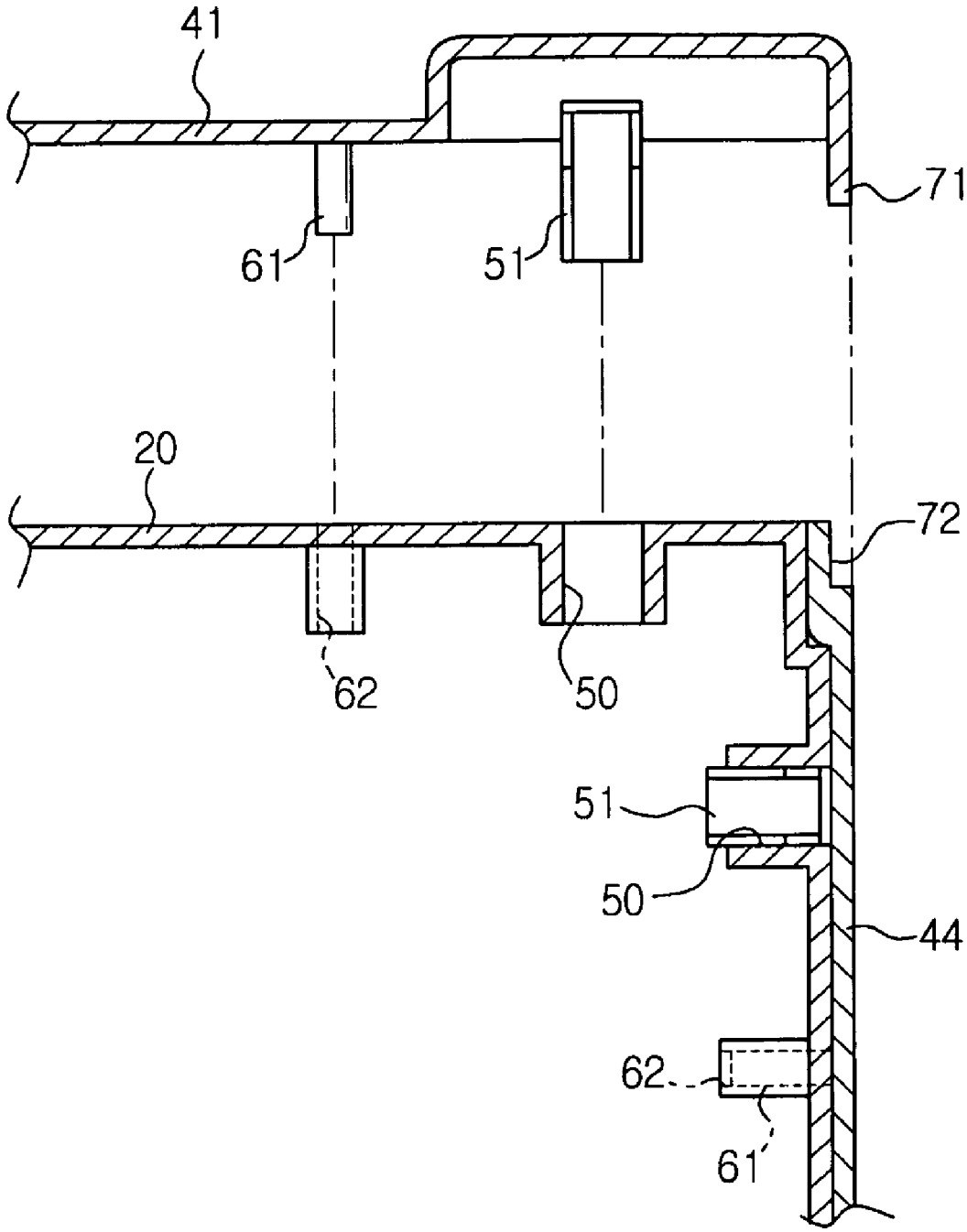
FIG. 6 is a sectional view illustrating the mounting structure of separated upper and lateral door trims included in the washing machine in accordance with the present embodiment.

Each of the upper and lower door trims 41 and 42, as shown in FIGS. 2 and 6, has cover portions 71 formed at opposite ends thereof to cover ends of the two lateral door trims 43 and 44. Each of the two lateral door trims 43 and 44 has stepped coupling portions 72 formed at both ends thereof to be covered by the cover portions 71. Accordingly, if the upper and lower door trims 41 and 42 are mounted at the upper and lower ends of the door 20 after the two lateral door trims 43 and 44 are previously mounted at opposite sides of the door 20, the stepped coupling portions 72 can be covered by the cover portions 71.

Figure 7:
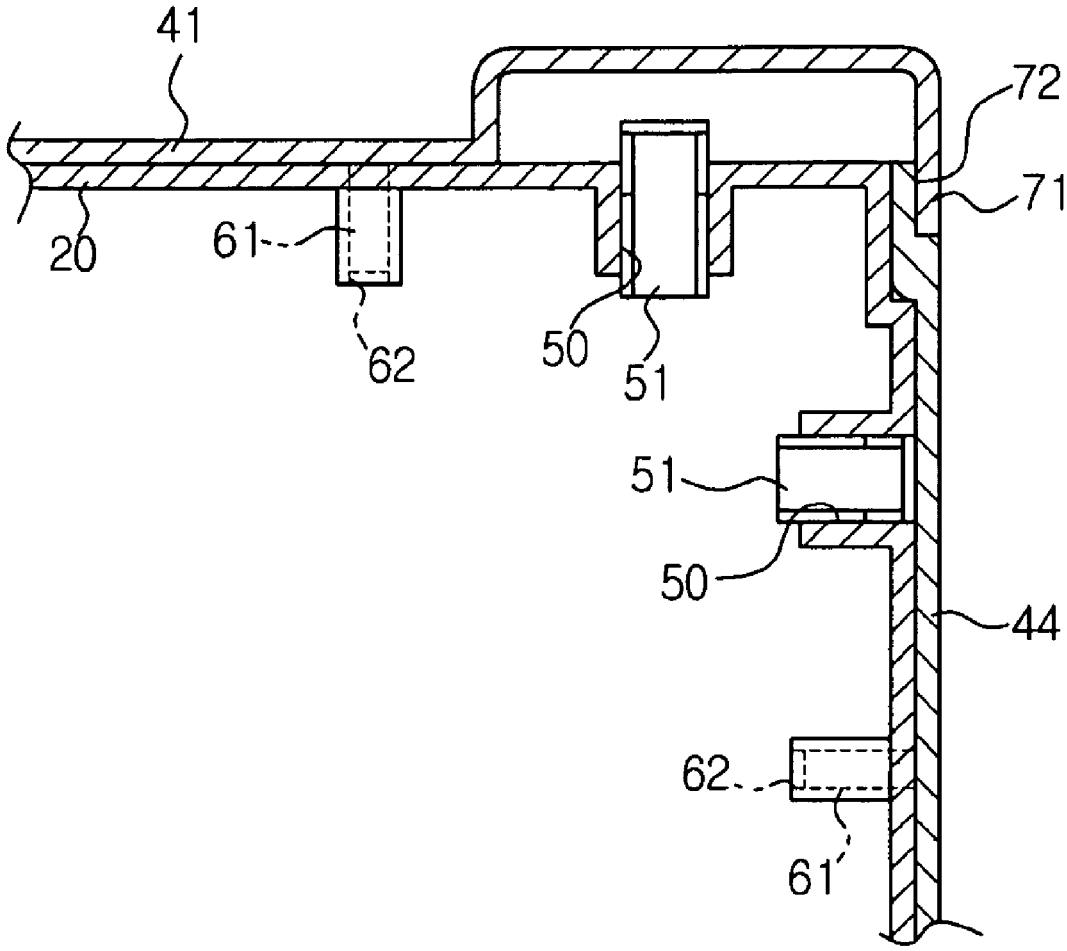
FIG. 7 is a sectional view illustrating the mounting structure of the coupled upper and lateral door trims included in the washing machine in accordance with the present embodiment.

The stepped portion of the stepped coupling portion 72 has a width corresponding to the thickness of the cover portion 71. Therefore, as shown in FIG. 7, an outer surface of the cover portion 71 of the upper or lower door trim 41 or 42 is leveled with an outer surface of the associated lateral door trim 43 or 44 after the coupling of both the door trims 41-44. With this coupling manner, the stepped coupling portions 72 of the two lateral door trims 43 and 44 are covered by the cover portions 71 of the upper and lower door trims 41 and 42, therefore there is no risk of the coming-off or distortion at the coupling regions of the door trims 41, 42, 43 and 44, resulting in an aesthetic outer appearance. The cover portions 71 and the stepped coupling portions 72 contribute to achieve a strong coupling of the respective door trims 41-44.

Hereinafter, methods of mounting and separating the ornamental panel to and from the front surface of the door will be described.

To mount the ornamental panel 30, after positioning the ornamental panel 30 on the front surface of the door 20, both the lateral door trims 43 and 44 are first mounted, and then, the upper and lower door trims 41 and 42 are mounted. In this case, the respective door trims 41, 42, 43 and 44 can be mounted at accurate positions without the risk of distortion because their coupling can be guided as the coupling guide protrusions 61 of the door trims 41-44 are introduced into the coupling guide bores 62 of the door 20. Further, after completing the mounting of the door trims 41-44 as stated above, the crooked end portions 51*a* of the holding hooks 51 are caught by the holding portions 50*a* of the holding recesses 50, therefore there is no risk of separation of the door trims. Furthermore, as the stepped coupling portions 72 of the two lateral door trims 43 and 44 are covered by the cover portions 71 of the upper and lower door trims 41 and 42, it is possible to prevent the coming-off or distortion of the door trims at their coupling regions. In this way, the present embodiment has the effect of achieving easy coupling of the door trims without using fixing screws, and consequently, mounting the ornamental panel 30 in a simplified manner.

When it is desired to separate the ornamental panel 30 for the change of color or pattern or to replace a damaged ornamental panel with a new one, as shown in FIG. 5, the crooked end portions 51*a* of the holding hooks 51 are pushed away from the inner surface of the door 20 in the direction as designated by the arrow A. Thereby, the holding hooks 51 are released, and the door trims 41, 42, 43 and 44 can be easily separated. In this case, the upper and lower door trims 41 and 42 are first separated, to release the cover portions 71 of the upper and lower door trims 41 and 42 from the stepped coupling portions 72.

As apparent from the above description, the present embodiment provides a washing machine in which door trims are mounted to a door via engagement of holding hooks and holding recesses, and the holding hooks can be easily separated from the holding recesses if necessary. With this configuration, the present embodiment has the effect of enabling an ornamental panel to be easily mounted to or separated from a front surface of the door. Consequently, the door trims can be easily mounted or separated without requiring fixing screws.

Further, according to the present embodiment, since the coupling of the door trims can be guided as coupling guide protrusions of the door trims are introduced into coupling guide bores of the door, the door trims can be mounted at accurate positions, and the mounted door trims have no risk of distortion or deformation.

Furthermore, according to the present embodiment, upper and lower door trims are provided with cover portions such that stepped coupling portions of the other two lateral door trims are covered by the cover portions. The use of the cover portions has the effect of preventing the coming-off or distortion of the door trims at their coupling regions.

Although an embodiment has been shown and described, it would be appreciated by those skilled in the art that changes may be made in this embodiment without departing from the principles and spirit of the invention, the scope of which is defined in the claims and their equivalents.

What is claimed is:

1. A washing machine, comprising:

a body having a laundry opening;

a door mounted to the body opening and closing the laundry opening and having a rim;

an ornamental panel mounted to an outer surface of the door;

a plurality of door trims coupled to the rim of the door supporting the ornamental panel; and a coupling device coupling the door trims to the door, the coupling device including a plurality of holding recesses formed in the rim of the door and spaced apart from one another, and a plurality of holding hooks protruding from an inner surface of the respective door trims to be introduced into and caught by the holding recesses, wherein each of the plurality of door trims has a bent portion to cover a rim of the ornamental panel, and each of the holding hooks includes a first supporting rib directly abutting against the ornamental panel to support the ornamental panel and to press the ornamental panel towards the associated bent portion, to prevent movement of the ornamental panel.

2. The washing machine according to claim 1, wherein the coupling device further includes a plurality of coupling guide protrusions extending from an inner surface of the respective door trims in a coupling direction of the respective door trims at positions between the neighboring holding hooks, and elongated coupling guide bores formed in the door and extending in the coupling direction of the respective door trims, to guide a coupling of the coupling guide protrusions.

3. The washing machine according to claim 1, wherein ends of the holding hooks are exposed to an inner surface of the door in a completely coupled state of the holding hooks, to allow the holding hooks to be easily separated from the holding recesses.

4. The washing machine according to claim 1, wherein each of the holding hooks further includes a second supporting rib extending from the first supporting rib to support the rim of the ornamental panel to space the rim of the ornamental panel apart from an inner surface of the associated door trim.

5. The washing machine according to claim 1, wherein:

the door and the ornamental panel have a rectangular panel shape to cover a front surface of the body, the door having upper and lower ends;

the plurality of door trims include upper and lower door trims mounted, respectively, to the upper and the lower ends of the door, and two lateral door trims coupled to both lateral ends of the door; and each of the upper and lower door trims has cover portions provided at both ends thereof to cover ends of the two lateral door trims, and each of the two lateral door trims has stepped coupling portions provided at both ends thereof to be covered by the cover portions.

6. The washing machine according to claim 5, wherein the coupling device further includes a plurality of coupling guide protrusions extending from an inner surface of the respective door trims in a coupling direction of the respective door trims at positions between the neighboring holding hooks, and elongated coupling guide bores formed in the door and extending in the coupling direction of the respective door trims, to guide a coupling of the coupling guide protrusions.

7. The washing machine according to claim 6, wherein ends of the holding hooks are exposed to an inner surface of the door in a completely coupled state of the holding hooks, to allow the holding hooks to be easily separated from the holding recesses.

8. The washing machine according to claim 5, wherein each of the plurality of door trims has a bent portion to cover the rim of the ornamental panel.

9. The washing machine according to claim 8, wherein each of the holding hooks includes a first supporting rib to support the ornamental panel to press the ornamental panel toward the associated bent portion, to prevent movement of the ornamental panel, and a second supporting rib extending from the first supporting rib to support the rim of the ornamental panel to space the rim of the ornamental panel apart from the inner surface of the associated door trim.

* * * * *